United States Patent [19]

Ikeda

[11] Patent Number: 4,637,537

[45] Date of Patent: Jan. 20, 1987

[54] PAPER FEEDER FOR A PRINTER

[75] Inventor: Hiroshi Ikeda, Tanashi, Japan

[73] Assignee: Citizen Watch Co., Ltd., Tokyo, Japan

[21] Appl. No.: 736,313

[22] Filed: May 21, 1985

[30] Foreign Application Priority Data

May 22, 1984 [JP] Japan ..... 59-74039[U]

[51] Int. Cl.[4] ..... B65H 20/20

[52] U.S. Cl. ..... 226/76; 226/82

[58] Field of Search ..... 226/76, 77, 78, 79, 226/80, 81, 82, 83, 84, 85, 86, 74, 75

[56] References Cited

U.S. PATENT DOCUMENTS

| | | | |
|---|---|---|---|
| 2,683,599 | 7/1954 | Davidson et al. | 226/79 |
| 2,923,543 | 2/1960 | Metzner et al. | 226/81 |
| 3,549,068 | 12/1970 | Calano | 226/79 |
| 3,747,820 | 7/1973 | Hawxhurst | 226/76 |
| 4,251,162 | 2/1981 | Kammerer et al. | 226/76 X |
| 4,304,345 | 12/1981 | Carlin | 226/74 |
| 4,364,504 | 12/1982 | Meyers | 226/76 |
| 4,394,949 | 7/1983 | Gomi | 226/82 X |
| 4,421,262 | 12/1983 | Chida et al. | 226/76 X |

FOREIGN PATENT DOCUMENTS

| | | | |
|---|---|---|---|
| 2062806 | 7/1972 | Fed. Rep. of Germany | 226/74 |

OTHER PUBLICATIONS

W. McNees, Semiautomatic Continuous Forms Loading, IBM Technical Disclosure Bulletin, vol. 22, No. 6, pp. 2171 and 2172.

*Primary Examiner*—Stanley N. Gilreath

*Attorney, Agent, or Firm*—Birch, Stewart, Kolasch & Birch

[57] ABSTRACT

A paper feeder unit for a printer is provided adjacent to a platen to feed a paper web to the platen. The unit has a sprocket wheel for feeding the paper web, and a paper holder rotatably mounted on a case so as to hold the paper web on the sprocket wheel. A paper guide plate is provided in a space between the platen and the paper holder so as to guide the surface of the paper web.

4 Claims, 4 Drawing Figures

PAPER FEEDER FOR A PRINTER

BACKGROUND OF THE INVENTION

The present invention relates to a paper feeder for a printer having a paper feed sprocket, and more particularly to a paper feeder having a paper holder which can be opened in order to engage a printing paper web with the feed sprocket. There are two kinds of paper feed methods, one of which is a paper web pushing method and the other is a paper web drawing method. The present invention is concerned with a paper feeder to feed a paper web by the pushing method.

FIG. 4 shows a conventional paper feeder for a printer. The paper feeder is disposed behind a platen 1 and comprises a pair of sprockets 5 and a paper holder 4 provided on each sprocket. The sprockets 5 are disposed at both ends of a printing paper web 2, and the paper holder is rotatably attached to a case (not shown) for the sprocket. A paper guide 3 is disposed under the platen 1 to guide the outer surface of the paper 2 fed by the paper feeder. A print head 6 is disposed adjacent to the platen 1. Thus, when the sprocket wheels 5 are rotated by a drive mechanism (not shown), the paper 2 is fed to the platen 1.

In such a device, in order to set the paper web, the paper holder 4 is opened as shown by the chain line of FIG. 4. Therefore, the paper feeder must be arranged spaced away from the platen 1 so as to avoid the holder 4 from touching the platen 1. Thus, the paper feeder is disposed behind the platen 1 with a large space 7. In such a disposition, the paper web 2 fed to the platen 1 buckles or wrinkles into a convex portion 2*a* in the space 7, which causes mis-feeding of the paper web 2. Particularly, it occurs when a plurality of sheets of paper are fed, one over another.

SUMMARY OF THE INVENTION

The object of the present invention is to provide a paper feeder for a printer which may prevent the paper web from buckling or wrinkling.

According to the present invention, a paper feeder unit comprises a drive shaft rotatably supported on frames of a printer, a case slidably engaged with a support plate of the printer, and a sprocket wheel rotatably mounted in the case and slidably engaged with the drive shaft. A paper holder is rotatably mounted on the case so as to hold the paper web on the sprocket wheel, and a paper guide plate is secured to the case. The paper guide plate has a paper guide portion positioned in a space betwen the platen and the paper holder so as to guide the surface of the paper web so that buckling or wrinkling of the web can be prevented.

These and other objects and features of the present invention will become more apparent from the following description with reference to the accompanying drawings.

DESCRIPTION OF THE PREFERRED EMBODIMENTS

Figure 1:
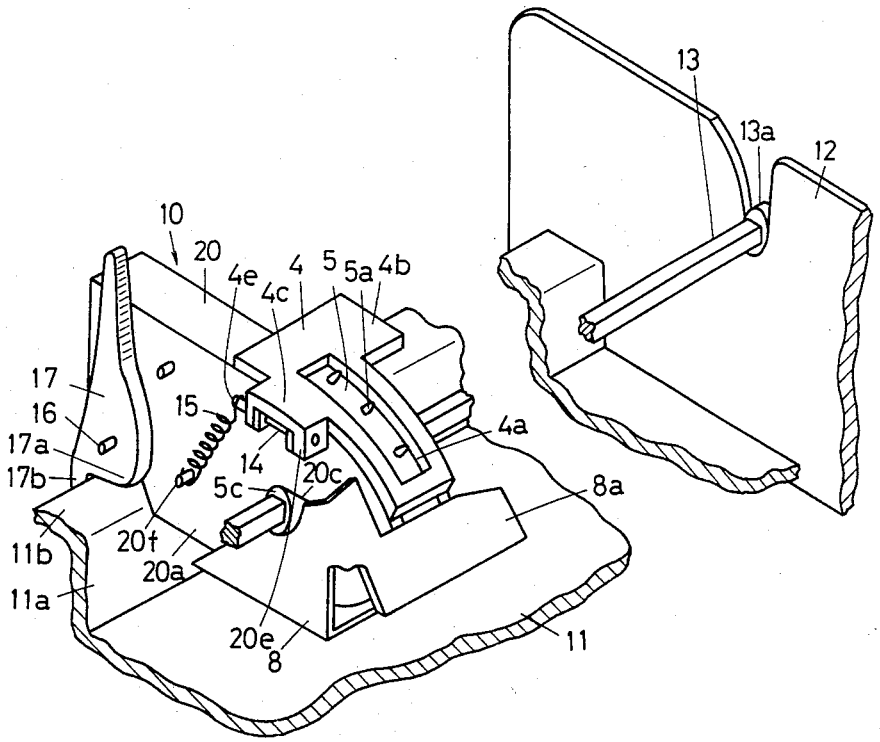
FIG. 1 is a perspective sectioned view showing a paper feeder according to the present invention.
Figure 2:
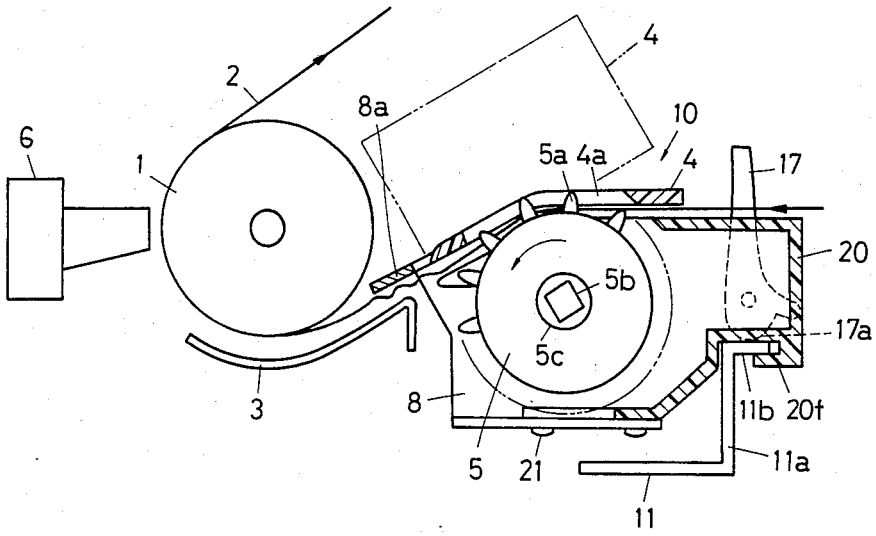
FIG. 2 is a schematic side view showing the paper feeder, a part of which is shown in section.

Referring to FIGS. 1 and 2 showing the paper feeder for a printer according to the present invention, a base support plate 11 of the printer comprises a pair of side frames 12 (the left hand one is not illustrated). A sprocket wheel drive shaft 13 having a rectangular cross section is rotatably supported on the side frames 12 by cylindrical shafts 13*a*, for supporting a pair of paper feeder units 10. The paper feeder unit at the right hand is not illustrated in the drawings.

The paper feeder unit 10 comprises a case 20, a sprocket wheel 5 rotatably supported on the case 20 and slidably engaged with the shaft 13, and a paper holder 4 pivotally mounted on the case 20 for holding the paper web 2. The case 20, sprocket wheel 5, and paper holder 4 are made of plastic.

The case 20 comprises a pair of side frames 20*a*, each having a notch 20*c* forming a circular inner wall for rotatably supporting cylindrical hubs 5*c* projected from both sides of the sprocket wheel 5.

The sprocket wheel 5 has a plurality of pins 5*a* on the outer periphery thereof adapted to engage with perforations formed longitudinally in both sides of the paper web 2. Each cylindrical hub 5*c* has a rectangular hole 5*b* which engages with the drive shaft 13.

The paper holder 4 has an elongated opening 4*a* for allowing pins 5*a* of the sprocket wheel 5 to pass through, a knob 4*b* for opening or closing the holder, and an engaging portion 4*c* formed on the opposite side from the knob 4*b*. The engaging portion 4*c* is rotatably mounted on a shaft 14 which is secured to supports 20*e* provided on an upper portion of one of the side frames 20*a*. A spring 15 is connected between an engaging pin 4*e* formed on the engaging portion 4*c* and a pin 20*g* provided on the case 20 so as to urge the holder 4 to the sprocket wheel 5 so that the paper web 2 is firmly held by the holder 4.

A paper guide plate 8 made of plastic or a thin metal plate is secured to the case 20 by screws 21 at the bottom plate thereof. The paper guide plate 8 has a paper guide portion 8*a* which is extended adjacent to the paper holder 4 so as to cover the space between the platen 1 and holder 4 and to guide the surface of the paper web 2.

The base plate 11 is bent at a rear portion to form an upright portion 11*a* and a bent end portion 11*b* for carrying the paper feeder unit on the plate. A hook portion 20*f* formed in a lower end portion of the case 20 is engaged with the bent end portion 11*b*.

A clamper 17 rotatably supported on a shaft 16 provided on a rear portion of the case 20 has a cam portion 17*a* and a stopper portion 17*b*. Rotation of the clamper 17 causes the cam portion 17*a* to engage with the bent end portion 11*b* to engage the hook 20*f* with the underside of the bent end portion 11*b*, so that the case 20 is secured to the plate 11.

As shown in FIG. 2, when the paper feeder unit 10 is disposed behind the platen 1, the paper guide portion 8*a* of the paper guide plate 8 is disposed in the space between the platen 1 and paper holder 4 at a portion adjacent to the surface of the paper web 2. Rotation of the sprocket wheel 5 in the counterclockwise direction (FIG. 2) causes the paper web 2 to move to the underside of the platen 1 along the underside of the paper guide portion 8*a*. Thus, the paper web is prevented from buckling or wrinkling by the guide portion 8*a*.

Figure 3:
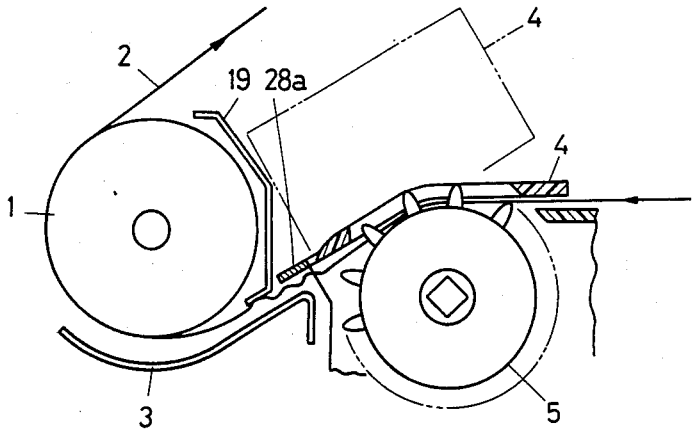
FIG. 3 is a schematic side view showing another embodiment of the present invention.
Figure 4:
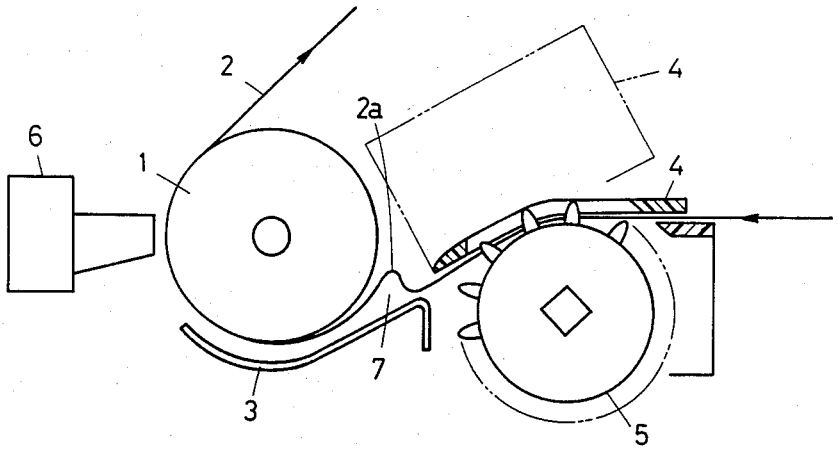
FIG. 4 PRIOR ART
FIG. 4 is a schematic side view showing a conventional paper feeder, a part of which is shown in section.

FIG. 3 shows another embodiment of the paper feeder unit of the present invention. In this embodiment, a paper guide frame 19 is disposed adjacent the platen 1. Thus, a paper guide portion 28*a* is disposed in the space between the paper guide frame 19 and the holder 4.

From the foregoing, it will be understood that the present invention provides a paper feeder which may reliably feed a paper web without buckling or wrinkling before the platen.

While the invention has been described in conjunction with certain preferred specific embodiments thereof, it will be understood that this description is intended to illustrate and not limit the scope of the invention, which is defined by the following claims.

What is claimed is:

1. In a printer having a frame, a platen, a pair of paper feed units provided adjacent to said platen to feed a paper web to an underside of said platen, and a common drive shaft for said feed units parallel with the axis of said platen and rotatably supported on the frame, each of said paper feed units comprising:

a case slidably engaged with a support plate of said frame;

a sprocket wheel rotatably mounted on said case and slidably engaged with said drive shaft;

clamping means for securing said case to said support plate;

a paper holder pivotally mounted on a shaft disposed on said case in the paper feeding direction so as to hold said paper web on an upper periphery of said sprocket wheel and to feed said paper web to said underside of the platen; and a paper guide plate secured to said case;

said paper guide plate having a paper guide portion positioned in a space between said platen and said paper holder so as to guide said paper web to said platen while preventing buckling or wrinkling of said paper web.

2. In a printer according to claim 1, wherein said sprocket wheel has a plurality of pins at the periphery thereof and a pair of cylindrical hubs projected from both sides.

3. In a printer according to claim 2, wherein each hub has a rectangular hole which is slidably engaged with said drive shaft having a rectangular cross section, and said sprocket wheel is rotatably mounted in the case at the cylindrical hubs.

4. In a printer according to claim 1, wherein said paper guide plate is made of plastic and secured to a bottom plate of said case in front of said paper holder between said platen and said holder.

* * * * *